US009960004B2

(12) United States Patent
Nützel et al.

(10) Patent No.: US 9,960,004 B2
(45) Date of Patent: May 1, 2018

(54) SEMI-TRANSPARENT PHOTOCATHODE WITH IMPROVED ABSORPTION RATE

(71) Applicant: Photonis France, Brive (FR)

(72) Inventors: Gert Nützel, Bordeaux (FR); Pascal Lavoute, Brive la Gaillarde (FR)

(73) Assignee: PHOTONIS FRANCE, Brive (FR)

( * ) Notice: Subject to any disclaimer, the term of this patent is extended or adjusted under 35 U.S.C. 154(b) by 0 days. days.

(21) Appl. No.: 14/433,403

(22) PCT Filed: Oct. 12, 2012

(86) PCT No.: PCT/EP2012/070313

§ 371 (c)(1),
(2) Date: Apr. 3, 2015

(87) PCT Pub. No.: WO2014/056550

PCT Pub. Date: Apr. 17, 2014

(65) Prior Publication Data

US 2015/0279606 A1 Oct. 1, 2015

(51) Int. Cl.

| | |
|---|---|
| ***H01J 40/06*** | (2006.01) |
| ***H01J 1/34*** | (2006.01) |
| ***H01J 40/16*** | (2006.01) |
| ***H01J 43/02*** | (2006.01) |

(52) U.S. Cl.
CPC ..... *H01J 1/34* (2013.01); *H01J 40/06* (2013.01); *H01J 40/16* (2013.01); *H01J 43/02* (2013.01)

(58) Field of Classification Search
CPC ..... H01J 1/34; H01J 40/06; H01J 40/16
USPC ..... 250/237 G; 313/373, 542
See application file for complete search history.

(56) References Cited

U.S. PATENT DOCUMENTS

| | | | | |
|---|---|---|---|---|
| 3,697,794 | A | 10/1972 | Stoudenheimer | |
| 4,999,211 | A | 3/1991 | Duggan | |
| 5,371,435 | A | 12/1994 | Ohishi | |
| 6,054,718 | A * | 4/2000 | Dodd | H01J 1/34 257/10 |
| 2010/0253218 | A1 | 10/2010 | Yamashita | |
| 2011/0079715 | A1 | 4/2011 | Nutzel | |
| 2013/0146778 | A1 | 6/2013 | Nutzel | |

FOREIGN PATENT DOCUMENTS

| | | | |
|---|---|---|---|
| CN | 102280343 | A | 12/2011 |
| CN | 202167452 | U | 3/2012 |
| EP | 2 006 876 | A1 | 12/2008 |
| JP | H03-205735 | A | 9/1991 |
| JP | H07-321358 | A | 12/1995 |
| WO | 99/50875 | A1 | 10/1999 |
| WO | 01/09915 | A1 | 2/2001 |

OTHER PUBLICATIONS

International Search Report issued in Application No. PCT/EP2012/070313 dated Feb. 6, 2013.

* cited by examiner

*Primary Examiner* — Thanh Luu
(74) *Attorney, Agent, or Firm* — Pearne and Gordon LLP

(57) ABSTRACT

The invention relates to a semi-transparent photocathode (1) for a photon detector having an increased absorption rate for a preserved transport rate. According to the invention, the photocathode (1) includes a transmission diffraction grating (30) able to diffract said photons and provided in the support layer (10) on which the photoemissive layer (20) is deposited.

11 Claims, 7 Drawing Sheets

SEMI-TRANSPARENT PHOTOCATHODE WITH IMPROVED ABSORPTION RATE

TECHNICAL FIELD

The present invention relates to the general field of semi-transparent photocathodes, and more precisely, to that of antimony and alkaline metal-type, or silver oxide (AgOCs)-type semi-transparent photocathodes, frequently used in electromagnetic radiation detectors such as, for example, image intensifier tubes and photomultiplier tubes.

STATE OF PRIOR ART

Electromagnetic radiation detectors such as, for example, image intensifier tubes and photomultiplier tubes enable an electromagnetic radiation to be detected by converting it into a light or electrical output signal.

They usually include a photocathode to receive the electromagnetic radiation and responsively emit a flow of photoelectrons, an electron multiplier device for receiving said flow of photoelectrons and responsively emit a flow of so-called secondary electrons, and then an output device to receive said flow of secondary electrons and responsively emit the output signal. As shown in FIG. 1, such a photocathode 1 usually comprises a transparent support layer 10 and a layer 20 of a photoemissive material deposited on a face 12 of said support layer.

The support layer 10 includes a so-called receiving front face 11, intended to receive the incident photons, and an opposite back face 12. The support layer 10 is transparent to the incident photons, and thus has a transmittance close to one.

The photoemissive layer 20 has an upstream face 21 in contact with the back face 12 of the support layer 10, and an opposite downstream face 22, called an emitting face, from which the generated photoelectrons are emitted.

Thus, the photons pass through the support layer 10 from the receiving face 11, and then enter the photoemissive layer 20.

They are then absorbed in the photoemissive layer 20 and generate electron-hole pairs therein. The electrons generated move to the emitting face 22 of the photoemissive layer 20 and are emitted in vacuum. The vacuum is indeed made inside the detector such that the movement of the electrons is not disturbed by the presence of gas molecules.

The photoelectrons are then directed and accelerated to an electron multiplier device such as a microchannel plate or a set of dynodes.

The photocathode yield, called the quantum yield, is conventionally defined by the ratio of the number of photoelectrons emitted to the number of incident photons received.

It depends in particular on the wavelength of the incident photons and the thickness of the photoemissive layer.

For illustrating purposes, for a S25-type photocathode, the quantum yield is in the order of 15% for a 500 nm wavelength.

The quantum yield more precisely depends on the three main steps, previously mentioned, of the photoemission phenomenon: the absorption of the incident photon and the formation of an electron-hole pair; the transport of the generated electron up to the emitting face of the photoemissive layer; and the emission of the electron in vacuum.

Each of these three steps has its own yield, the product of the three yields defining the quantum yield of the photocathode.

However, the yields of the absorption and transport steps are directly dependant on the thickness of the photoemissive layer.

Thus, the yield $\varepsilon_a$ of the absorption step is an increasing function of the thickness of the photoemissive layer. The thicker the photoemissive layer, the higher the ratio of the number of absorbed photons to the number of incident photons. The photons which have not been absorbed are transmitted through the photoemissive layer.

On the other hand, the yield $\varepsilon_t$ of the transport phase, that is the ratio of the electrons reaching the emitting face to the electrons generated, is a decreasing function of the thickness of the photoemissive layer. The higher the thickness of the layer, the lower the yield $\varepsilon_t$. Indeed, the greater the distance to travel, the most likely are the generated electrons to be recombined with the holes.

Thus, there is an optimum thickness which maximizes the product of the absorption rate $\varepsilon_a$ with the transport rate $\varepsilon_t$, and thus the quantum yield.

For illustrating purposes, for the S25-type photocathode frequently used in image intensifier tubes, the optimum thickness of the photoemissive layer, made of SbNaK, or $SbNa_2KCs$, is usually between 50 and 200 nm.

FIG. 2 illustrates, for such a photoemissive layer, the time course of the absorption rate $\varepsilon_a$ as a function of the wavelength of the incident photons, as well as the reflection rates $\varepsilon''$ of the incident photons and the transmission rates $\varepsilon'$ of the same through the photoemissive layer.

It appears that, for large wavelengths, in particular wavelengths close to the photoemission threshold, the absorption rate $\varepsilon_a$ strongly decreases whereas the transmission rate $\varepsilon'$ increases.

Thus, for incident photons at 800 μm wavelength, only 40% of them are absorbed whereas 60% are transmitted through the photoemissive layer.

To decrease the transmission rate of the photoemissive layer for the benefit of the absorption rate in order to increase the quantum yield, in particular at great wavelengths, a solution could be to increase the thickness of said layer.

Thus, increasing the thickness to 280 nm of the previously mentioned photoemissive layer results in, for the 800 μm wavelength, an absorption rate of 64%, instead of 40%, and a transmission rate decreased to 36%.

However, this causes a strong decrease in the transport rate given that the generated electrons have further distance to travel up to the emitting face of the photoemissive layer, and are thus more likely to be recombined.

Thus, the increase in the thickness of the photoemissive layer, though improving the absorption rate, does not result in an increase in the quantum yield, in particular at the great wavelengths, since the transport rate is degraded.

DISCLOSURE OF THE INVENTION

The invention has mainly the purpose to provide a semi-transparent photocathode for a photon detector, including a photoemissive layer having a high absorption rate of the incident photons and a preserved transport rate of the electrons.

For this, one object of the invention is to provide a semi-transparent photocathode for a photon detector, including:

- a transparent support layer having a front face to receive said photons and an opposite back face, and
- a photoemissive layer provided against said back face and having an opposite emitting face, intended to receive said photons from said support layer and to responsively emit photoelectrons from said emitting face.

According to the invention, said photocathode includes a transmission diffraction grating able to diffract said photons, provided in the support layer and located at said back face.

By so-called semi-transparent photocathode, it is intended a photocathode the photoelectrons of which are emitted from an emitting face opposite to the receiving face of the incident photons. It is distinguished from said opaque photocathodes for which electrons are emitted from the receiving face of the photons.

The support layer is indicated as transparent given that it enables incident photons to be transmitted. The transmittance of the support layer, or the ratio of the transmitted photons to the received photons, is thus close to or equal to one.

Thus, incident photons enter the support layer through the so-called receiving front face and pass through it up to the opposite back face.

They are thus diffracted by the diffraction grating towards the photoemissive layer.

They enter the photoemissive layer with a diffraction angle substantially different from the incidence angle.

By definition, the incidence, diffraction and refraction angles of the photons are measured with respect to the normal of the face considered. Thus, the previously mentioned incidence and diffraction angles are defined with respect to the normal of the back face of the support layer at which the diffraction grating is provided.

When a photon arrives on the diffraction grating with a substantially null incidence angle, it enters the photoemissive layer with a non-null diffraction angle. Generally, for a given distribution of the incidence angle, a substantially more spread distribution of the diffraction angle is observed.

Thus, for a thickness of the photoemissive layer, noted e and measured along the thickness direction thereof, the mean apparent thickness for the photons is $e \cdot E(1/|\cos \alpha_d|)$, where $\alpha_d$ is the diffraction angle of the photons and $E(\cdot)$ designates the mean taken on the angular distribution of the diffraction angle of the photons.

The absorption rate of the photoemissive layer is then higher than that of the photocathode according to the previously mentioned prior art, given that it is an increasing function of the thickness, here of the apparent thickness, of the photoemissive layer.

Furthermore, the transport rate is thus preserved given that it does not depend on the apparent thickness of the photoemissive layer viewed by the photons, but on the actual thickness thereof. Indeed, when the photons generate electron-hole pairs, the electrons generated move to the emitting face regardless of the prior propagation direction of the photons.

Thus, the photocathode according to the invention has a high absorption rate of the photons and a preserved transport rate of the electrons.

This enables the quantum yield of the photocathode to be improved.

It is to be noted that the quantum yield for great wavelengths, thus close to the photoemission threshold, is significantly increased, given that the photons with such wavelengths tend, according to the abovementioned example of prior art, to be more transmitted than absorbed.

Said diffraction grating is advantageously etched in the back face of the support layer.

Said diffraction grating is preferably provided so as to bound at least partly the back face of the support layer.

Said diffraction grating is preferably formed of a periodical arrangement of patterns filled with a material having an optical index different from the material of the support layer.

By patterns, it is intended indentations, or nicks, or recesses or notches, or scratches having a sinusoidal, with steps, trapezoidal shape, provided in the support layer.

Preferably, the difference between the optical indices of the material of the diffraction grating present in said patterns on the one hand and of the material of the support layer on the other hand is higher than or equal to 0.2.

Advantageously, the grating spacing and/or the material of the diffraction grating are selected such that the photons are diffracted in the photoemissive layer with a diffraction angle strictly higher than $\arcsin(1/n_p)$.

According to another embodiment, the photocathode comprises at least one further diffraction grating able to diffract said photons, which is located in the support layer and provided in the vicinity of said first diffraction grating, formed of a periodical arrangement of patterns filled with a material having an optical index different from the material of the support layer.

The diffraction gratings are oriented along distinct directions, and distant from each other by a negligible distance with respect to the mean thickness of the support layer. This distance is about one tenth to ten times the wavelength considered.

The periodical arrangement of patterns of said at least one further diffraction grating can be offset along a direction orthogonal to the thickness direction of the support layer with respect to the arrangement of said first diffraction grating.

Alternatively, the diffraction grating and the further diffraction grating are provided in the same plane.

The photoemissive layer can comprise antimony and at least one alkaline metal.

Such a photoemissive layer can be made of a material selected from SbNaKCs, $SbNa_2KCs$, SbNaK, SbKCs, SbRbKCs or SbRbCs.

Alternatively, the photoemissive layer can be formed of AgOCs.

The photoemissive layer has preferably a substantially constant thickness.

The photoemissive layer has preferably a thickness lower than or equal to 300 nm.

The invention also relates to a photon detection optical system including a photocathode according to any of the preceding characteristics, and an output device for emitting an output signal in response to the photoelectrons emitted by said photocathode.

Such an optical system can be an image intensifier tube or a photomultiplier tube.

Further advantages and characteristics of the invention will appear in the detailed non limiting description below.

BRIEF DESCRIPTION OF THE DRAWINGS

Embodiments of the invention will now be described, by way of non limiting examples, referring to the appended drawings, wherein.

DETAILED DISCLOSURE OF A PREFERRED EMBODIMENT

Figure 1:
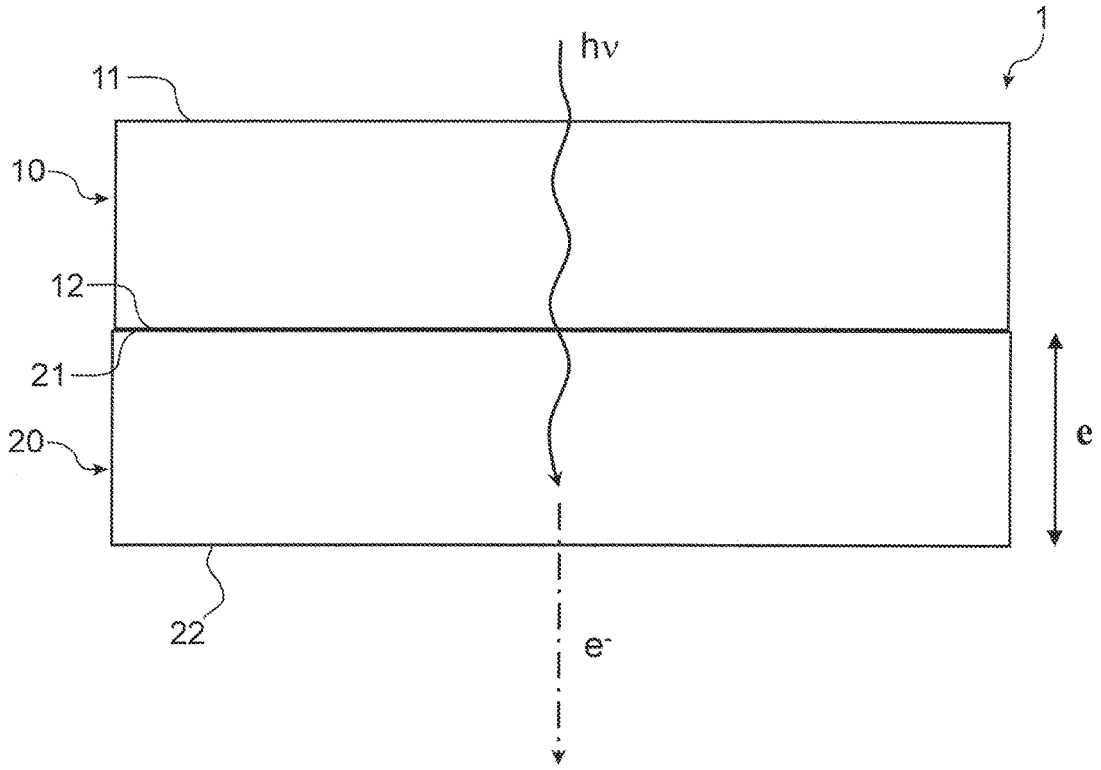
Fig. 1 PRIOR ART
FIG. 1, already described, is a schematic transverse cross-section view of a photocathode according to an example of prior art.
Figure 2:
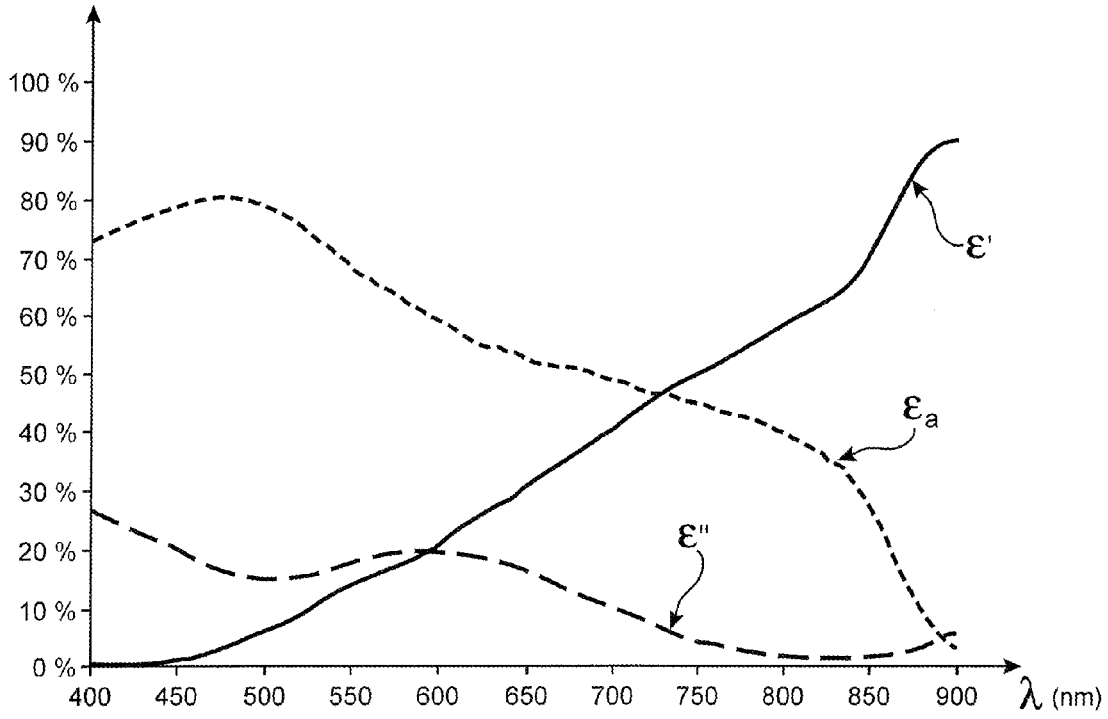
FIG. 2, already described, illustrates an example of the time course of the absorption, transmission and reflection rates as a function of the wavelength of a 140 nm-thickness photoemissive layer of a S25-type photocathode according to an example of prior art.
Figure 3:
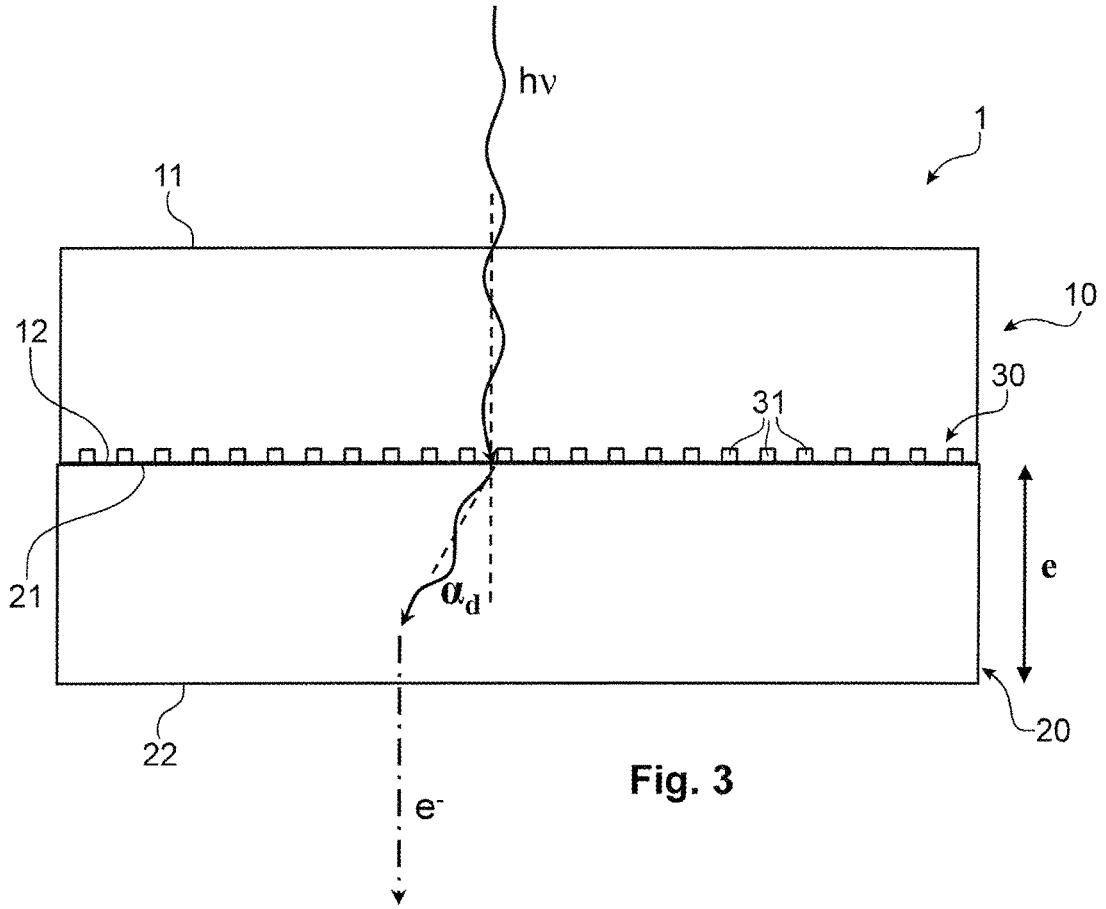
FIG. 3 is a schematic transverse cross-section view of the photocathode according to a first preferred embodiment of the invention.
Figure 4:
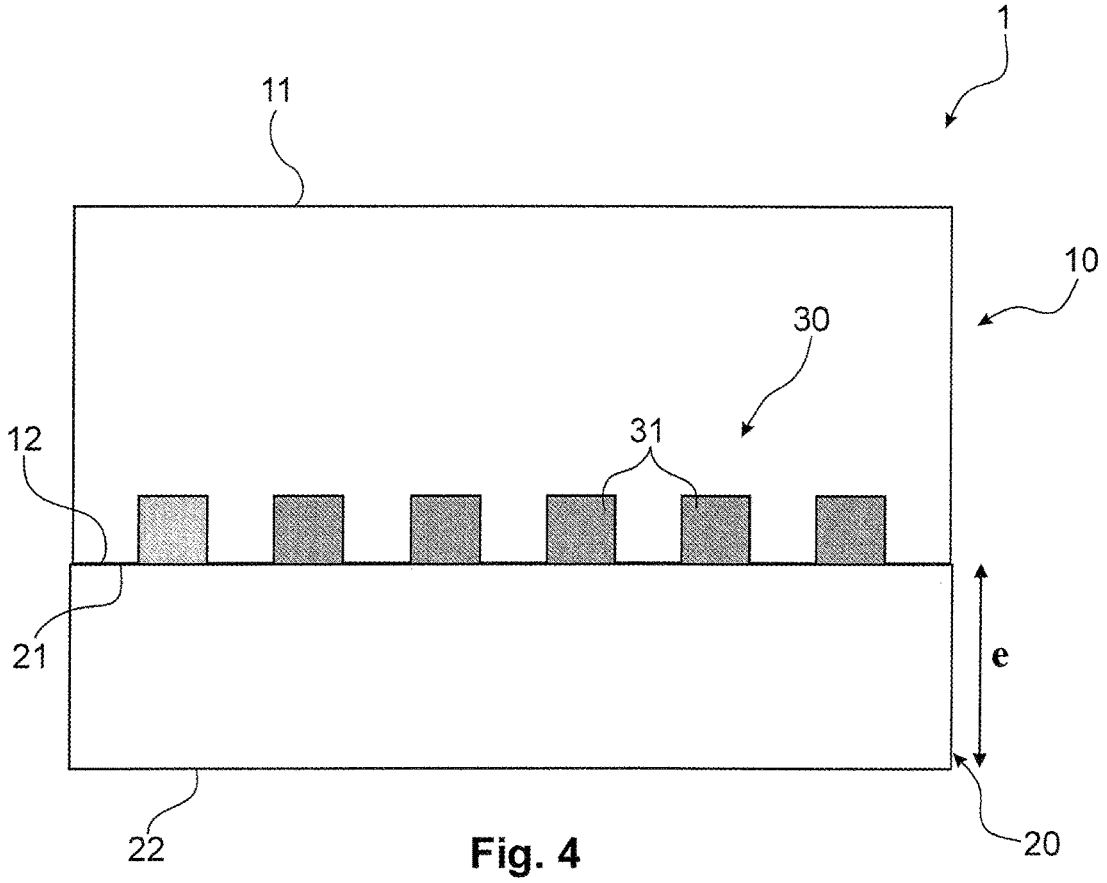
FIG. 4 is a schematic enlarged cross-section view of a part of the photocathode illustrated in FIG. 3.

FIGS. 3 and 4 illustrate a semi-transparent photocathode 1 according to a first preferred embodiment of the invention.

It should be noted that the scales are not respected, for the sake of the drawing's clarity.

The photocathode 1 according to the invention can equip any type of photon detector, such as for example an image intensifier tube or an electron multiplier tube.

The photocathode has a function to receive a flow of incident photons and to responsively emit electrons, called photoelectrons.

It comprises a transparent support layer 10, a layer 20 of a photoemissive material and, according to the invention, at least one diffraction grating 30 able to diffract the incident photons.

The support layer 10 is a layer of a transparent material on which the photoemissive layer 20 is deposited.

It is indicated as transparent given that the incident photons pass through it without being absorbed. The transmittance of the support layer 10 is thus substantially equal to one.

It includes a front face 11, called a photon receiving face, and an opposite back face 12.

At least one transmission diffraction grating 30 is provided in the support layer 10 at said back face 12.

In the preferred embodiment of the invention illustrated in FIGS. 3 and 4, a single diffraction grating 30 is provided.

The diffraction grating 30 is formed of a periodical arrangement of patterns 31 filled with a material having an optical index different from the material of the support layer 10.

By patterns, it is intended indentations, nicks, recesses, notches, or scratches, having a sinusoidal, with steps, trapezoidal, or other shape, provided in the support layer.

The difference between the optical indices of the material of the diffraction grating 30 present in said patterns 31 on the one hand and of the material of the support layer 10 on the other hand is higher than or equal to 0.2.

The diffraction grating 30 is in particular characterized by the distance, called the grating spacing, between two neighboring patterns 31. The grating spacing is defined as a function of the wavelength of the incident photons, so as to be able to diffract them.

As shown in detail in FIG. 4, the diffraction grating 30 can be provided in the support layer 10 at the back face 12, thus bounding at least partly the back face 12.

Alternatively, the diffraction grating can be provided inside the support layer and located in close vicinity to the back face, at a distance thereof being negligible with respect to the thickness of the support layer.

It is to be noted that the back face 12 of the support layer 10 is substantially planar. It can however be curved in the case of a photocathode itself having a defined curvature.

In FIG. 4, the diffraction grating 30 is located in the support layer 10, such that the material filling the patterns 31 of the grating does not project from said patterns. However, as will be seen during the manufacture of the photocathode, the material filling the patterns 31 can, according to one alternative, form a layer between the back face 12 of the support layer and the photoemissive layer 20.

The photoemissive layer 20 is provided against the back face 12 of the support layer 10.

It has an upstream face 21, in contact with the back face 12 of the support layer 10, and an opposite downstream face 22, called the photoelectron emitting face.

The photoemissive layer 20 has a substantially constant mean thickness, noted e. The thickness is preferably lower than or equal to 300 nm.

The photoemissive layer 20 is made of a suitable semiconductor material, preferably an antimony-based alkaline compound. Such an alkaline material can be selected from SbNaKCs, $SbNa_2KCs$, SbNaK, SbKCs, SbRbKCs, or SbRbCs. The photoemissive layer 20 can also be formed of silver oxide AgOCs.

The emitting face 22 can be treated with hydrogen, cesium, or cesium oxide to decrease its electronic affinity. Thus, the photoelectrons which reach the downstream emitting face 22 of the photoemissive layer 20 can be naturally extracted therefrom and thus be emitted in the vacuum.

An electrode (not represented), forming an electron reservoir, is in contact with the photoemissive layer 20 and is brought to an electric potential.

It can be provided against a side face of the photoemissive layer 20, not to decrease or disturb the electron emission from the downstream emitting face 22.

The electron reservoir enables holes generated by the incident photons to be recombined. Thus, the overall electric charge of the photoemissive layer 20 remains substantially constant.

It should be noted that the photoemissive layer 20 is thin enough for the generated electrons to be naturally moved to the emitting face 22.

It is therefore not required to generate an electric field in the photoemissive layer 20 to ensure the electrons transport to the emitting face. The generation of such an electric field would indeed require to deposit two bias electrodes, one against the upstream face 21 of the photoemissive layer 20 and the other against the downstream emitting face 22.

The operation of the photocathode according to the invention is described hereinafter.

Photons enter the photocathode 1 through the front receiving face 11 of the support layer 10.

They pass through the support layer 10 up to the back face 12 thereof.

They are then diffracted by the diffraction grating 30 and transmitted in the photoemissive layer 20. They have statistically a diffraction angle substantially higher, in absolute value, to the incidence angle, the incidence and diffraction angles being defined with respect to the normal of the back face 12.

More precisely, if $\alpha=\alpha_i$ is the incidence angle on the grating, $f(\alpha)$ the angular distribution of the incident beam, $\alpha_d$ the diffraction angle, the angular distribution of the diffracted beam can be written as:

$$F(\alpha)=\Pi\otimes f(\alpha)\approx f(\alpha+\theta)+f(\alpha-\theta)$$

where Π is the diffraction figure of the grating and the approximation is made by restricting to the first order of diffraction with $\theta=\lambda/p$ where p is the grating spacing.

The angular distribution of the diffracted beam is consequently more spread than that of the incident beam. The electrons face a photoemissive layer 20 having a mean apparent thickness:

$$e_d = e\int_{-\alpha_{max}+\theta}^{\alpha_{max}+\theta}\frac{F(\alpha_d)}{|\cos\alpha_d|}d\alpha_d$$

where e is the actual thickness of the layer and $\alpha_{max}$ is the maximum incidence angle on the grating.

The mean apparent thickness $e_d$ of the photoemissive layer is substantially higher than its actual thickness e, in other words the mean distance traveled by the photons in the layer is substantially higher than in prior art. As a result, a higher percentage of the diffracted photons is absorbed.

The absorption of the diffracted photons causes the generation of electron-hole pairs. The electrons generated are propagated in the photoemissive layer 20 up to the downstream emitting face 22 where they are emitted in vacuum.

Since the transport of electrons in the photoemissive layer 20 is independent of the prior propagation direction of the photons, the transport rate of the photoemissive layer 20 is substantially equal to that of a photocathode according to prior art, that is without diffraction grating. The transport rate is thus preserved.

The photocathode 1 according to the invention thus has a high absorption rate and a preserved transport rate, which results in an optimized quantum yield, in particular for energies close to the photoemission threshold.

The photocathode 1 according to the invention can be made as follows.

The support layer 10 is made of a suitable transparent material, for example of quartz or borosilicate glass.

The patterns 31 of the diffraction grating 30 are etched in the support layer 10 at the back face 12 by known etching techniques, such as, for example, the holography and/or ionic etching, or even diamond engraving techniques.

The patterns 31 are then filled with a diffraction material the optical index of which is different from that of the support layer, as, for example, $Al_2O_3$ (n~1.7), $TiO_2$ (n~2.3-2.6) or $Ta_2O_5$ (n~2.2), or even $HfO_2$.

This material can be deposited by known physical vapor deposition techniques, such as, for example, sputtering, evaporation, or Electron Beam Physical Vapor Deposition (EBPVD). Known chemical vapor deposition techniques such as, for example, Atomic Layer Deposition (ALD) can also be used, as well as known so-called hybrid techniques such as, for example, reactive spraying and Ion Beam Assisted Deposition (IBAD).

According to a first advantageous alternative, illustrated in FIG. 4, the back face 12 is polished so as to remove any extra diffraction material projecting from the patterns 31 of the diffraction grating 30.

According to a second alternative, not represented, the back face is polished without being flush with the back face. As a result, a uniform layer of diffraction material remains present on the back face 22, in continuity with the patterns.

Regardless of the alternative, a thin diffusion barrier can then be deposited to prevent any chemical migration/interaction between the material of the photoemissive layer and the material of the diffraction grating. The thickness of the diffusion barrier is selected thin enough (less than λ/4 and preferably in the order of λ/10).

In any case, the photoemissive layer 20 is then deposited by one of the previously mentioned deposition techniques.

By way of illustration, a S25-type photocathode 1 according to the first preferred embodiment of the invention can be made in the following way.

The support layer 10 is made of quartz.

The diffraction grating 30 is etched in the support layer 10 at the back face 12, in the form of a periodic arrangement of grooves 31 parallel to each other.

The grooves 31 are 341 nm wide and 362 nm deep. The grating spacing, that is the distance separating two neighboring and parallel grooves 31, is 795 nm.

The grooves 31 are filled for example with $TiO_2$, the optical index of which is between 2.3 and 2.6.

The $TiO_2$ can be deposited by the known atomic layer deposition (ALD) technique.

A step of polishing the back face 12 is carried out to remove any extra diffraction material projecting from the grooves 31.

Thus, the back face 12 is substantially planar, and partly bounded by the material (quartz) of the support layer 10 and partly by the diffraction material ($TiO_2$) of the grooves 31 of the diffraction grating 30.

The photoemissive layer 20 is finally made of SbNaK or $SbNa_2KCs$ and is deposited on the back face 12 of the support layer 10 so as to be substantially constantly 50 to 240 nm thick.

Figure 5:
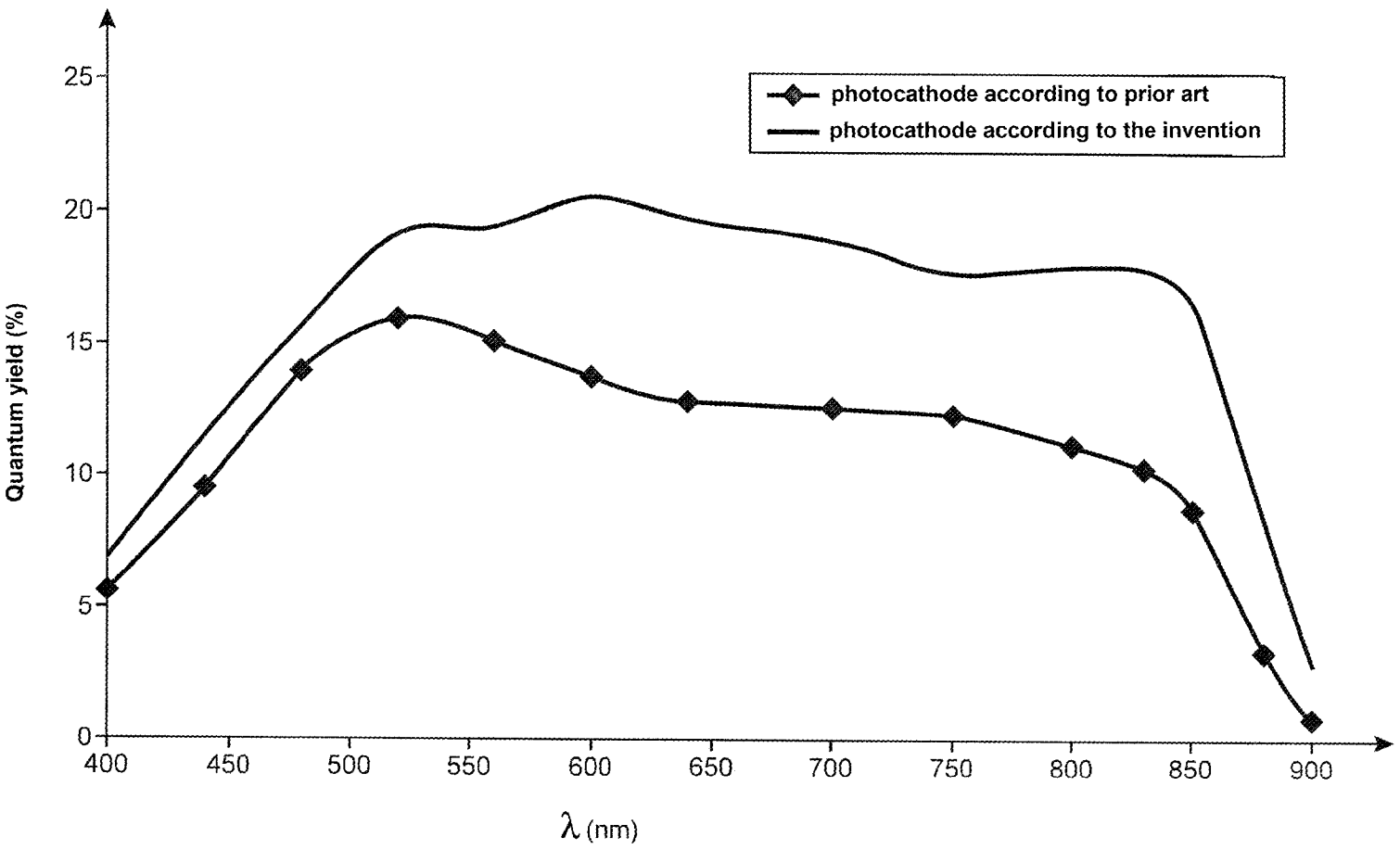
FIG. 5 illustrates an example of the time course of the quantum yield as a function of the wavelength for a photocathode according to the prior art and for a photocathode according to the first preferred embodiment of the invention.

FIG. 5 illustrates the time course of the quantum yield as a function of the wavelength of the incident photons, for such a photocathode on the one hand and for a photocathode according to the example of prior art previously described on the other hand.

It is noticed that the quantum yield is improved throughout the wavelength range, and more particularly at great wavelengths.

Thus, for λ~825 nm, the quantum yield of the photocathode according to the invention is in the order of 18%, whereas it is in the order of 10% in the case of a photocathode without a diffraction grating, which yields an improvement close to 80% of the quantum yield.

Figure 6:
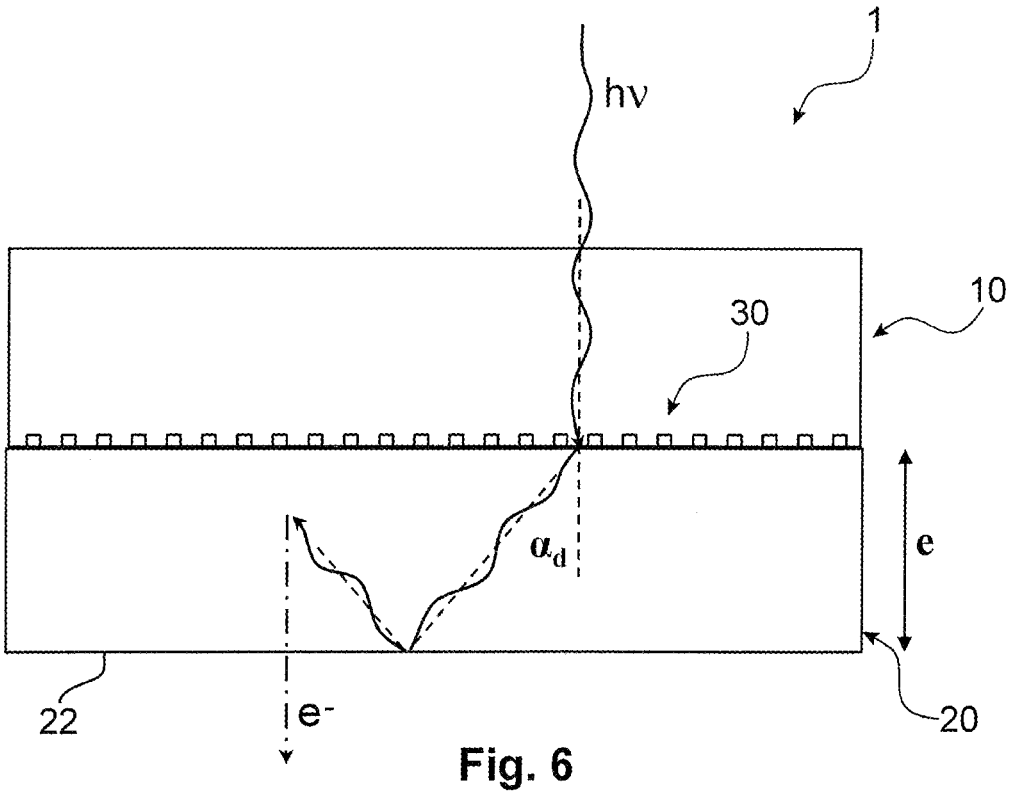
FIG. 6 is a schematic transverse cross-section view of the photocathode according to another preferred embodiment of the invention, wherein the diffracted photons are fully reflected at the emitting layer of the photocathode.

FIG. 6 illustrates a photocathode according to a second embodiment of the invention.

Reference numerals identical to those of FIG. 3 previously described designate identical or similar elements.

The photocathode 1 only differs from the first preferred embodiment in that the diffraction grating 30 is dimensioned such that any photon arriving under normal incidence ($\alpha_i$=0), diffracted and not absorbed in the photoemissive layer 20, is reflected at the downstream emitting face 22.

Alternatively, the diffraction grating 30 is advantageously dimensioned such that the mean diffraction angle $\overline{\alpha_d}$ (in view of the angular distribution $F(\alpha_d)$) is strictly higher than $\arcsin(1/n_p)$ where $n_p$ is the optical index of the photoemissive layer. More precisely, the spacing p of the grating and/or the optical index of the diffraction material filling the patterns 31 are selected such that the mean diffraction angle $\overline{\alpha_d}$ is strictly higher than $\arcsin(1/n_p)$.

Thus, these reflected photons remain located in the photoemissive layer 20 until the absorption thereof and the generation of electron-hole pair.

This enables the transmission rate of the photons of the photoemissive layer 20 to be significantly decreased in benefit of the absorption rate.

Since the transport rate of the electrons remains unchanged, the quantum yield of the photocathode is consequently further improved, in particular for photons having an energy close to the photoemission threshold.

Figure 7:
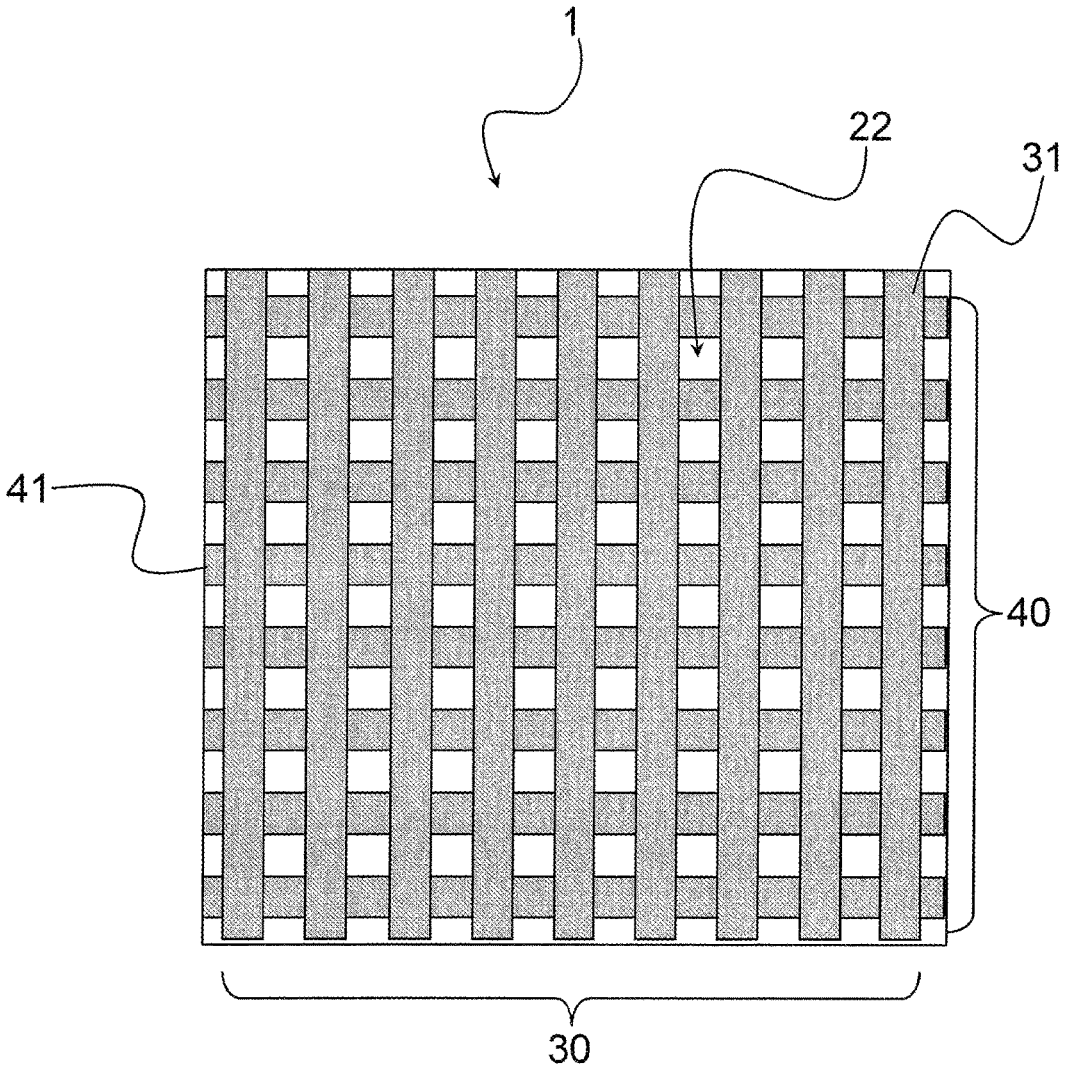
FIG. 7 is a schematic transverse cross-section view of the photocathode according to another preferred embodiment of the invention, wherein the photocathode comprises two diffraction gratings.

FIG. 7 illustrates a photocathode, viewed from above, according to a third embodiment of the invention, wherein two diffraction gratings 30, 40 are present in the support layer 10 at the back face 12.

The reference numerals identical to those of FIG. 3 previously described designate identical or similar elements.

The photocathode only differs from the first preferred embodiment in the presence of a further diffraction grating 40 in the support layer 10.

This further grating 40 is provided in the vicinity of the first diffraction grating 30, upstream the same along the propagation direction of the photons.

Both these gratings 30, 40 are oriented along distinct, preferably orthogonal directions, and are distant from each other by a distance negligible with respect to the thickness of the support layer, for example by a distance in the order of $\lambda/10$ to $10\lambda$.

The further grating 40 is for example of the same spacing as the previously described first diffraction grating 30.

According to an alternative, the first diffraction grating and the further grating are made in a same plane according to a two-dimensional pattern the transmission function of which is the product of the respective transmission functions of the first grating and the further grating. The two-dimensional pattern can be obtained by holographic techniques.

In the hypothesis of two orthogonal gratings, the angular distribution of the diffracted photons can thus be written as:

$$F(\alpha,\beta)=\Pi\otimes f(a,\beta)\approx f(\alpha+\theta,\beta+\theta)+f(\alpha+\theta,\beta-\theta)+f(\alpha-\theta,\beta-\theta)+f(\alpha-\theta,\beta-\theta)$$

by keeping the same notations, where $\alpha$ and $\beta$ are respectively the incidence angles of the photon in the plane perpendicular to the direction of the first grating and in the plane perpendicular to the direction of the further grating, $\theta=\lambda/p$; $\theta=\lambda/p'$ where p and p' are the spacings of the first grating and the further grating.

Thus, the angular distribution is more spread than in the first embodiment and the apparent thickness of the photoemissive layer 20 for the photons is higher, which improves the absorption rate.

Those skilled in the art will understand that this embodiment is not restricted to two diffraction gratings. A greater number of diffraction gratings having distinct directions can be present in the support layer at the back face.

On the other hand, various modifications can be made by those skilled in the art to the invention just described only by way of non limiting examples.

Finally, the abovedescribed photocathode can be integrated in a photon detection optical system. Such an optical system comprises an output device suitable for converting photoelectrons into an electrical signal. This output device can include a CCD array, the optical system being known as an Electron Bombarded CCD (EB-CCD). Alternatively, the output device can include a CMOS array on a thinned passivated substrate, the optical system being then known as an Electron Bombarded CMOS (EBCMOS).

What is claimed is:

1. A semi-transparent photocathode (1) for a photon detector, including:

a transparent support layer (10) having a front face (11) to receive said photons and an opposite back face (12), and a photoemissive layer (20) deposited directly on said back face (12) and having an opposite emitting face (22), intended to receive said photons from said support layer (10) and to responsively emit photoelectrons from said emitting face (22), characterized in that it includes a transmission diffraction grating (30) able to diffract said photons, provided in the support layer (10) and located at said back face (12);

said diffraction grating (30) being formed of a periodical arrangement of patterns (31) filled with a pattern material having an optical index different from the material of the support layer (10);

said diffraction grating (30) being further provided so as to bound at least partly the back face (12) of the support layer (10) by being flush with the same.

2. The photocathode (1) according to claim 1, characterized in that a layer of said pattern material is directly provided on the back face, in continuity with said patterns.

3. The photocathode (1) according to claim 1 or 2, characterized in that it includes at least a further diffraction grating (40) able to diffract said photons, which is located in the support layer (10) and provided in the vicinity of said first diffraction grating (30), formed of a periodical arrangement of patterns (41) along a direction distinct from that of the patterns of the first grating.

4. The photocathode (1) according to claim 3, characterized in that the diffraction grating (30) and the further diffraction grating (40) are located in a same plane and made by means of two-dimensional patterns.

5. The photocathode (1) according to claim 4, characterized in that the photoemissive layer (20) comprises antimony and at least one alkaline metal.

6. The photocathode (1) according to claim 5, characterized in that the photoemissive layer (20) is made of a material selected from SbNaKCs, $SbNa_2KCs$, SbNaK, SbKCs, SbRbKCs, or SbRbCs.

7. The photocathode (1) according to claim 4, characterized in that the photoemissive layer (20) is formed of AgOCs.

8. The photocathode (1) according to claim 1, characterized in that the photoemissive layer (20) has a substantially constant thickness.

9. The photocathode (1) according to claim 8, characterized in that the photoemissive layer (20) has a thickness lower than or equal to 300 nm.

10. A photon detection optical system including a photocathode (1) according to claim 1, and an output device for emitting an output signal in response to the photoelectrons emitted by said photocathode (1).

11. The photon detection optical system according to claim 10, being an image intensifier tube or a photomultiplier tube, of the EB-CCD or EBCMOS type.

* * * * *